US008388084B2

(12) United States Patent
Nagai et al.

(10) Patent No.: US 8,388,084 B2
(45) Date of Patent: Mar. 5, 2013

(54) LIQUID EJECTION HEAD, METHOD FOR EVALUATION OF LIQUID EJECTION HEAD, AND LIQUID EJECTION APPARATUS HAVING LIQUID EJECTION HEAD

(75) Inventors: Masataka Nagai, Yokohama (JP); Yoshinori Tagawa, Yokohama (JP); Satoshi Ibe, Yokohama (JP); Kazuhiro Asai, Kawasaki (JP); Masaki Ohsumi, Yokosuka (JP)

(73) Assignee: Canon Kabushiki Kaisha, Tokyo (JP)

( * ) Notice: Subject to any disclaimer, the term of this patent is extended or adjusted under 35 U.S.C. 154(b) by 331 days.

(21) Appl. No.: 12/952,550

(22) Filed: Nov. 23, 2010

(65) Prior Publication Data

US 2011/0148960 A1 Jun. 23, 2011

(30) Foreign Application Priority Data

Dec. 21, 2009 (JP) ..... 2009-288807
Dec. 21, 2009 (JP) ..... 2009-288808

(51) Int. Cl.
*B41J 29/38* (2006.01)
*B41J 2/15* (2006.01)

(52) U.S. Cl. ..... 347/9; 347/20

(58) Field of Classification Search ..... 324/762.02; 347/65, 46, 19, 9, 20
See application file for complete search history.

(56) References Cited

U.S. PATENT DOCUMENTS 4,516,071 A * 5/1985 Buehler ..... 324/762.02
4,716,423 A * 12/1987 Chan et al. ..... 347/65
5,942,900 A * 8/1999 DeMeerleer et al. ..... 324/537
5,953,027 A * 9/1999 Suwabe et al. ..... 347/46
6,830,309 B2 12/2004 Murakami
7,798,595 B2 * 9/2010 Hatsui et al. ..... 347/19

FOREIGN PATENT DOCUMENTS

JP 2007-098701 A 4/2007

* cited by examiner

*Primary Examiner* — Stephen Meier
*Assistant Examiner* — Carlos A Martinez
(74) *Attorney, Agent, or Firm* — Canon USA Inc IP Division

(57) ABSTRACT

The opening area and shape of ejection orifices provided in an ejection orifice member influence the amount of liquid droplet. Therefore, it is necessary to check the opening area and shape of the ejection orifices in detail. For this purpose, in a liquid ejection head having ejection orifices used for ejecting liquid using energy generated by energy generating elements and a dummy ejection orifice having the same shape as the ejection orifices and not used for ejection of liquid, an examination member is provided at a position facing the dummy ejection orifice.

15 Claims, 15 Drawing Sheets

| NUMBER OF UNRECOGNIZABLE CELLS | RANK |
|---|---|
| LESS THAN 83 | A |
| EQUAL TO OR GREATER THAN 83 BUT LESS THAN 94 | B |
| EQUAL TO OR GREATER THAN 94 BUT LESS THAN 107 | C |
| EQUAL TO OR GREATER THAN 107 BUT LESS THAN 120 | D |
| EQUAL TO OR GREATER THAN 120 | E |

LIQUID EJECTION HEAD, METHOD FOR EVALUATION OF LIQUID EJECTION HEAD, AND LIQUID EJECTION APPARATUS HAVING LIQUID EJECTION HEAD

BACKGROUND OF THE INVENTION

1. Field of the Invention

The present invention relates to a liquid ejection head that performs recording operation by ejecting liquid, a method for evaluation of a liquid ejection head, and a liquid ejection apparatus having a liquid ejection head.

2. Description of the Related Art

A liquid ejection head typified by an ink-jet recording head can perform recording operation by ejecting liquid from ejection orifices. The ejection orifices are provided in an ejection orifice member provided on a liquid ejection head substrate having energy generating elements that generate energy used for ejecting liquid. The size of ejected liquid droplets heavily depends on the opening area of the ejection orifices. Therefore, if the opening area varies from head to head, the size of liquid droplets varies from head to head, and the recording quality is uneven.

A method for checking the opening area of ejection orifices without actually ejecting liquid droplets is disclosed in U.S. Pat. No. 6,830,309 and Japanese Patent Laid-Open No. 2007-098701. A liquid ejection head disclosed in U.S. Pat. No. 6,830,309 has, in addition to ejection orifices that eject liquid, a dummy ejection orifice and can estimate the opening area of the ejection orifices by counting pixels of an image of the dummy ejection orifice.

A diagram disclosed in Japanese Patent Laid-Open No. 2007-098701 is shown in FIG. 15. An ejection orifice member 20 having ejection orifices 21 and flow passages 22 is provided on a liquid ejection head substrate 14 having heat generating elements 11. An exposure mask used for forming the ejection orifices 21 of the ejection orifice member 20 has a plurality of slit-like masks having different widths near the ejection orifices 21. By performing exposure and development using such an exposure mask, the ejection orifices 21 and a plurality of slits 23 are formed in the ejection orifice member 20. By evaluating the number and/or the deformation amount of the slits formed in the ejection orifice member 20, the diameter of the ejection orifices 21 can be estimated.

However, in the case of the method disclosed in U.S. Pat. No. 6,830,309, it is necessary to capture an image of the liquid ejection head using a microscope and to binarize and count pixels in image processing, and it takes time to estimate the opening diameter. Therefore, this method is not adequate for mass production.

The method disclosed in Japanese Patent Laid-Open No. 2007-098701 is an indirect measurement method such that the shape of slits is checked in place of the opening shape of ejection orifices. It is open to question whether a factor that influences the opening shape of ejection orifices always also influences the shape of slits to the same degree.

SUMMARY OF THE INVENTION

The present invention provides a liquid ejection head such that the state of the openings of ejection orifices can be checked more precisely without ejecting liquid droplets.

In an aspect of the present invention, a liquid ejection head includes a liquid ejection head substrate including a surface having energy generating elements that generate energy for ejecting liquid, and an ejection orifice member having a facing portion that faces the surface and a plurality of through-holes defined through the facing portion. The plurality of through-holes include liquid ejection orifices corresponding to the energy generating elements. A part of the surface facing a portion of the plurality of through-holes is provided with an examination member facilitating examining a state of the portion of the plurality of through-holes.

Because part of the surface facing a portion of the plurality of through-holes is provided with an examination member used for examining the state of the portion of the plurality of through-holes, the state of the openings of the ejection orifices can be checked without ejecting liquid droplets.

Further features of the present invention will become apparent from the following description of exemplary embodiments with reference to the attached drawings.

DESCRIPTION OF THE EMBODIMENTS

A liquid ejection head can be mounted in a printer, a copying machine, a facsimile machine having a communication system, a word processor having a printer portion, and an industrial recording apparatus combined with various processors. By using a liquid ejection head, recording can be performed on various recording media, for example, paper, thread, fiber, cloth, leather, metal, plastic, glass, wood, and ceramics.

The term "recording" used in this specification means not only forming significant images such as characters and figures on a recording medium but also forming insignificant images such as patterns.

The term "ink" is to be understood to have a broad meaning. It means a liquid that is applied to a recording medium for formation of an image, a pattern, or the like, processing of the recording medium, or treatment of ink or the recording medium. Treatment of ink or the recording medium means, for example, improvement in fixability, improvement in recording quality or color development, and improvement in image durability by solidifying or insolubilizing the color material in ink applied to the recording medium.

Figure 1A:
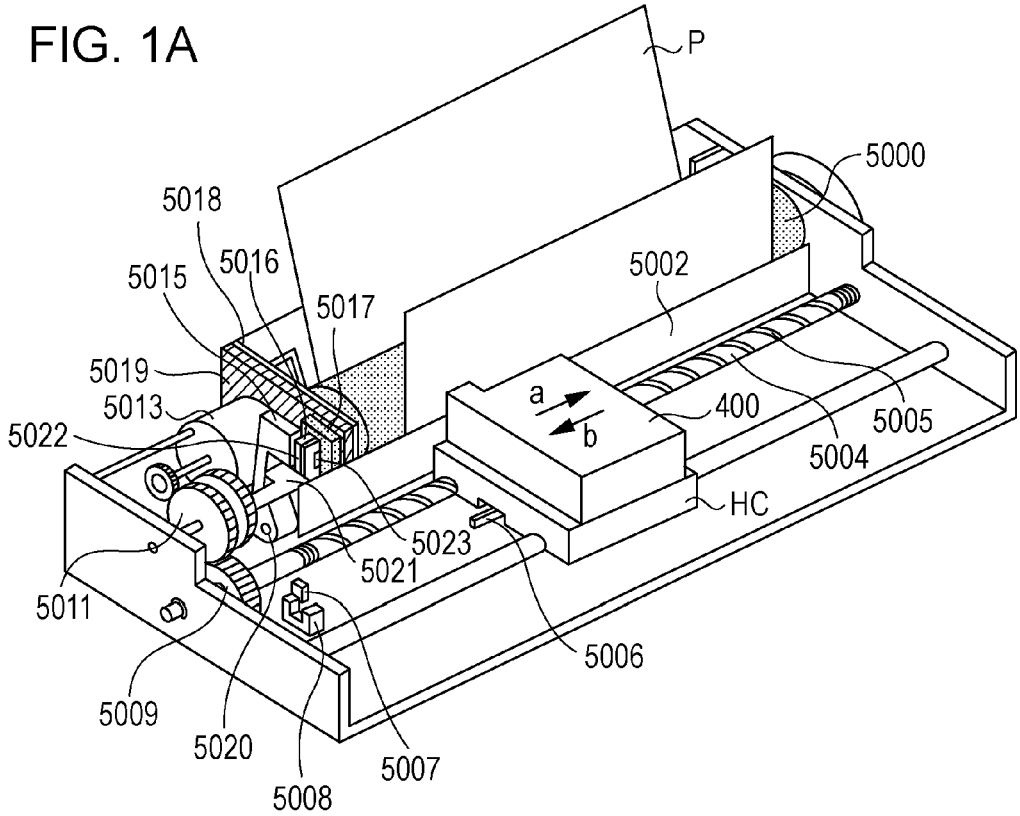
FIGS. 1A and 1B are perspective views of a liquid ejection apparatus and a head unit, respectively, in which the present invention can be used.

FIG. 1A is a schematic view showing a liquid ejection apparatus in which a liquid ejection head according to the present invention can be mounted. As shown in FIG. 1A, a lead screw 5004 rotates in response to forward/reverse rotation of a driving motor 5013, and driving force transmission gears 5011 and 5009 transmit the driving force of the driving motor 5013 to the lead screw 5004. A head unit can be mounted on a carriage HC. The carriage HC has a pin (not shown) that engages with a spiral groove 5005 of the lead screw 5004. The carriage HC is reciprocated in the directions of arrows a and b by the rotation of the lead screw 5004. A head unit 40 is mounted on the carriage HC.

A paper pressing plate 5002 presses recording paper P against a platen 5000 over the moving range of the carriage HC. Photosensors 5007 and 5008 are home position detecting elements that detect a lever 5006 of the carriage HC in a detection region, for example, in order to change the direction of rotation of the motor 5013. A cap 5022 that hermetically covers the front surface of the head unit 40 is supported by a supporting member 5016. A suction member 5015 that sucks the inside of the cap 5022 performs suction recovery of the head unit 40 through an opening 5023 in the cap 5022. A cleaning blade 5017 and a member 5019 that makes the cleaning blade 5017 movable in the front-back direction are supported by a main body supporting plate 5018. The configuration of the cleaning blade 5017 is not limited to this configuration, and other known cleaning blades can be used in this embodiment. A lever 5021 for starting suction in the suction recovery operation moves with the movement of a cam 5020 in engagement with the carriage HC. The driving force from the driving motor is controlled by a transmission mechanism such as a clutch.

When the carriage HC is moved to a region on the home position side, the capping, cleaning, and suction recovery operations are performed at their respective positions by the action of the lead screw 5004.

Figure 1B:
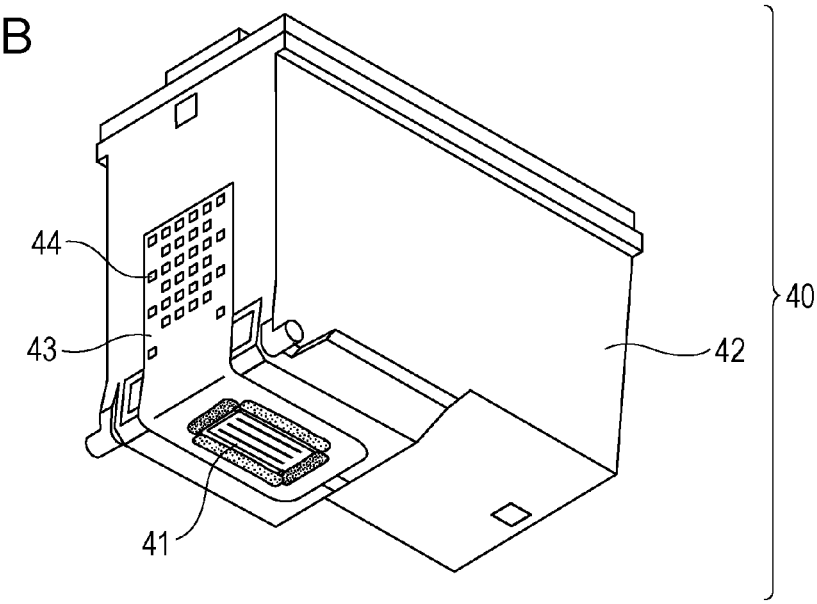

FIG. 1B is a perspective view of a head unit 40 that can be mounted in a liquid recording apparatus such as that shown in FIG. 1A. A liquid ejection head 41 (hereinafter also referred to as head) is electrically connected by a flexible film wiring substrate 43 that is connected to a connection terminal 7, to a contact pad 44 that is to be connected to a liquid recording apparatus. The head 41 is connected to a supporting substrate, thereby being supported by the head unit 40. In this head unit 40, the head 41 is integrated with an ink tank. However, a head unit having a detachable ink tank can also be used.

Figure 2A:
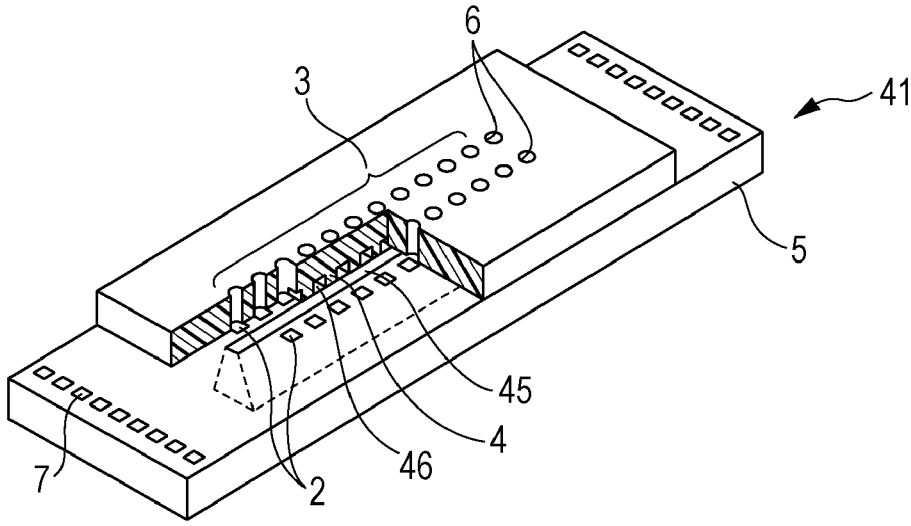
FIGS. 2A and 2B are examples of perspective views of a liquid ejection head in which the present invention can be used.
Figure 2B:
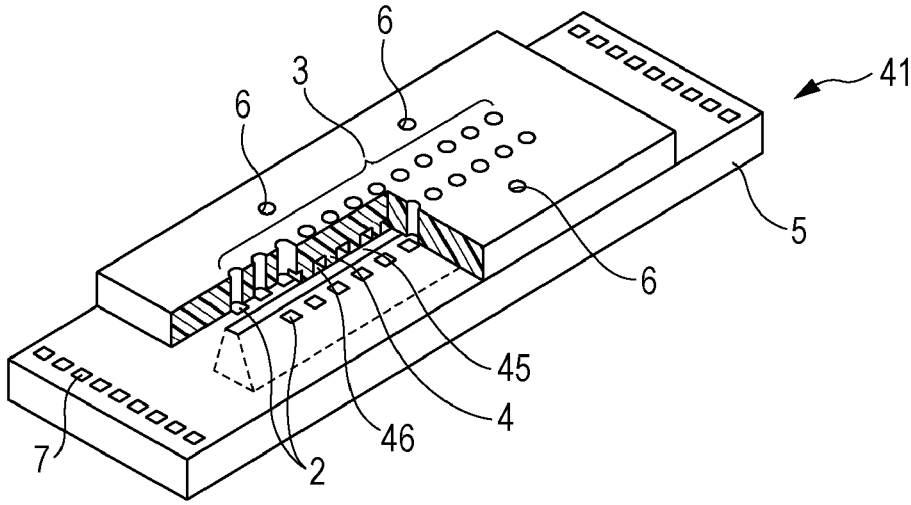

FIGS. 2A and 2B are perspective views showing a liquid ejection head 41, which is a characterizing portion of the present invention. The liquid ejection head 41 of the present invention has a liquid ejection head substrate 5 having energy generating elements 2, and an ejection orifice member 4 provided on the liquid ejection head substrate 5. The ejection orifice member 4 has a plurality of through-holes provided through a facing portion that faces a surface of the liquid ejection head substrate 5 on which the energy generating elements 2 are provided. The ejection orifice member 4 is formed of a resin material. The plurality of through-holes are formed at the same time using a photolithographic technique and an etching technique. The through-holes provided in the ejection orifice member 4 each have a first opening that faces the surface of the liquid ejection head substrate 5 on which the energy generating elements 2 are provided and a second opening on the side from which liquid is ejected.

A portion of the plurality of through-holes (first through-holes) are used as ejection orifices 3 through which liquid is ejected using energy generated by the energy generating elements 2. These are aligned at a predetermined pitch and form an ejection orifice array. The other portion of the plurality of through-holes (second through-holes) are used as dummy ejection orifices 6 that are not used for recording operation. When the second through-holes have substantially the same size and shape as the first through-holes, the second through-holes can be used more reliably.

When the dummy ejection orifices 6 are provided continuously along the ejection orifice array as shown in FIG. 2A, the dummy ejection orifices 6 can be put in substantially the same state as the ejection orifices 3. When the dummy ejection orifices 6 are provided near the ejection orifice array as shown in FIG. 2B, the state of the whole liquid ejection head can be checked. Therefore, the state of all the ejection orifices 3 of the liquid ejection head 41 can be estimated more precisely. The term "near" used here means about the same distance as the distance between adjacent ejection orifices 3.

For example, electrothermal transducers (heaters) or piezoelectric elements can be used as the energy generating elements 2 provided in the liquid ejection head substrate. The energy generating elements 2 are provided so as to face the ejection orifice array and form element arrays. Between the element arrays, a supply port 45 is provided that is provided through a base body 5 and supplies liquid to the energy generating elements 2. This liquid ejection head is provided with a single supply port 45. However, the present invention can also be applied to a liquid ejection head having a plurality of supply ports 45. The ejection orifice member 4 is further provided with recesses 46*a* that are communicated with the ejection orifices 3 or the dummy ejection orifices 6. When the ejection orifice member 4 is in contact with the liquid ejection head substrate, the recesses 46*a* each form a part of a flow passage 46.

Figure 3:
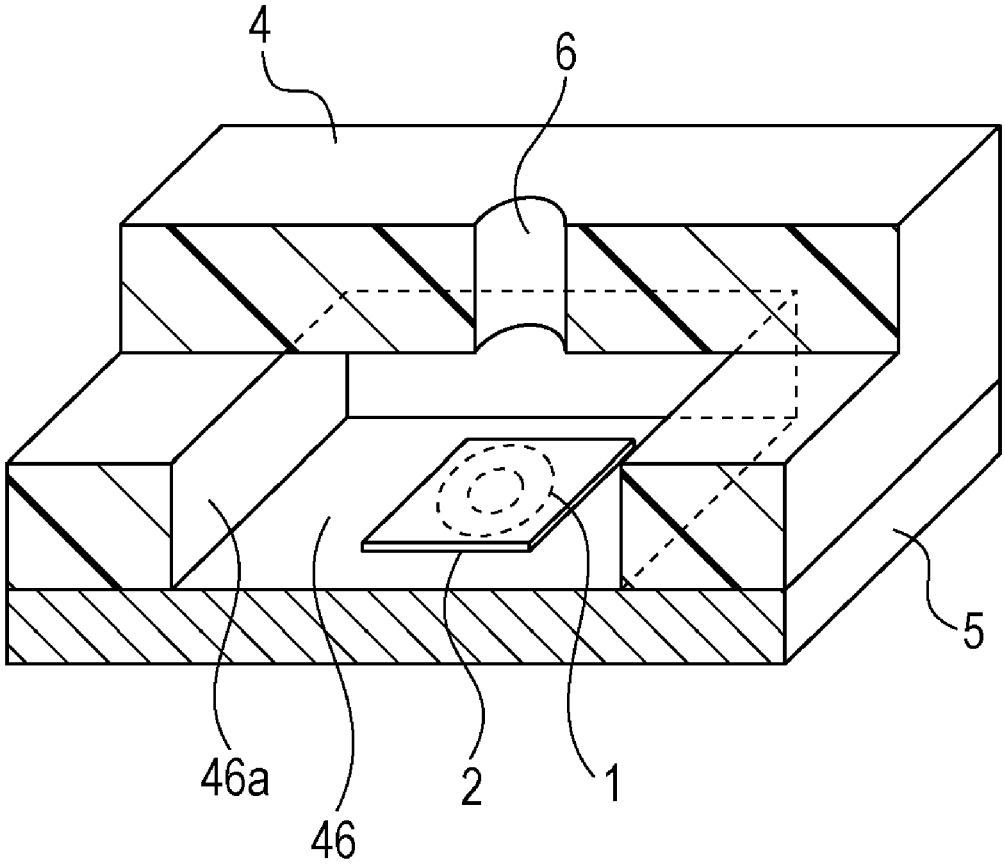
FIG. 3 is an example of a partially see-through perspective view of a dummy ejection orifice of the present invention.

FIG. 3 is a partially see-through cross-sectional perspective view of a dummy ejection orifice 6 provided in the liquid ejection head 41 according to a first embodiment. An examination member 1 having a plurality of protruding portions is provided at a position facing the dummy ejection orifice 6. The examination member 1 serves as a reference member for evaluating the shape of ejection orifices. Except for the examination member 1, the components provided at a position facing the dummy ejection orifice 6 have the same sizes and shapes as those provided at a position facing each ejection orifice 3.

The examination member 1 is desirably at least part of a plurality of concentric circles having different diameters, a plurality of concentric squares having different sizes, or a combination thereof. The protruding portions have such a thickness that the protruding portions can be recognized when the examination member 1 is checked through the dummy ejection orifice 6. Although the shown dummy ejection orifice 6 faces the energy generating element 2, the energy generating element 2 does not necessarily have to face the dummy ejection orifice 6 and may be provided at a different position.

By determining whether the examination member 1 can be checked through the dummy ejection orifice 6 and the opening of the dummy ejection orifice 6, the size of the dummy ejection orifice 6, that is to say, the size of the ejection orifices 3 can be classified (ranked). In addition, by checking the amount of misalignment between the dummy ejection orifice 6 and the examination member 1, the amount of misalignment between the ejection orifice member 4 and the liquid ejection head substrate can be estimated. Because the dummy ejection orifice 6 is formed through the same process and under the same conditions as the ejection orifices 3, the ejection orifices 3 can be ranked by ranking the dummy ejection orifice 6. Such an examination member 1 is not provided at a position facing each ejection orifice 3. The reason is that providing each ejection orifice 3 with such a member results in adverse effects, for example, change in the direction in which liquid is ejected at the time of recording operation.

The examination member 1 can be checked through the opening of the dummy ejection orifice 6 not only using an optical microscope or the like but also using an automatic measurement device.

On the basis of the result, the state (rank) of the liquid ejection head is written into an information storage medium (not shown), and ejection control suited to each liquid ejection head is performed. Thus, if there are differences between individual liquid ejection heads, differences in recording quality can be eliminated.

The liquid ejection head is fabricated as follows. A plurality of liquid ejection heads are formed on a wafer at the same time using a semiconductor process and are then separated from the wafer. The protruding portions of the examination member 1 of such a liquid ejection head have a sufficiently small thickness compared to the ejection orifice member 4. Because the protruding portions of the examination member 1 have a small thickness, there is little variation from head to head. In contrast, in the case of the ejection orifice member 4, which has a large thickness, variation tends to occur in the wafer plane at the time of manufacturing, and the size of the ejection orifices 3 or the dummy ejection orifices 6 tends to vary from head to head. By determining the size of dummy ejection orifices 6 of a plurality of liquid ejection heads using the examination member 1, which varies little, as a benchmark, the size of the ejection orifices 3 can be reliably evaluated. Thus, highly reliable ranking of liquid ejection heads can be performed.

A description will be given of an example in which electrothermal transducers (heat generating elements) are used as the energy generating elements 2. In such a liquid ejection head, thermal energy generated by the heat generating elements 2 causes film boiling of liquid. This pressure ejects liquid from the ejection orifices, and recording operation is performed.

Figure 4A:
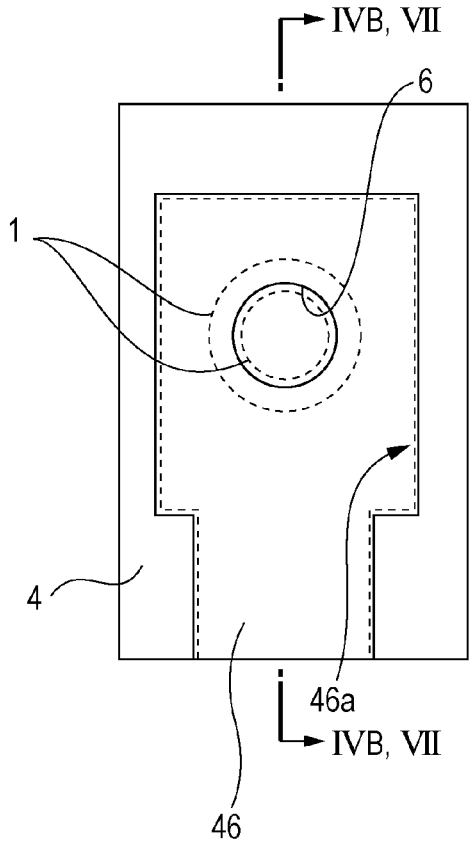
FIGS. 4A and 4B are a top plan schematic view and a sectional view, respectively, of a dummy ejection orifice of a first embodiment.

FIG. 4A is a top plan schematic view of a dummy ejection orifice 6. Although a description will be given with reference to the sectional view of the dummy ejection orifice 6, ejection orifices 3 have the same configuration as the dummy ejection orifice 6 except for the examination member 1.

Figure 4B:
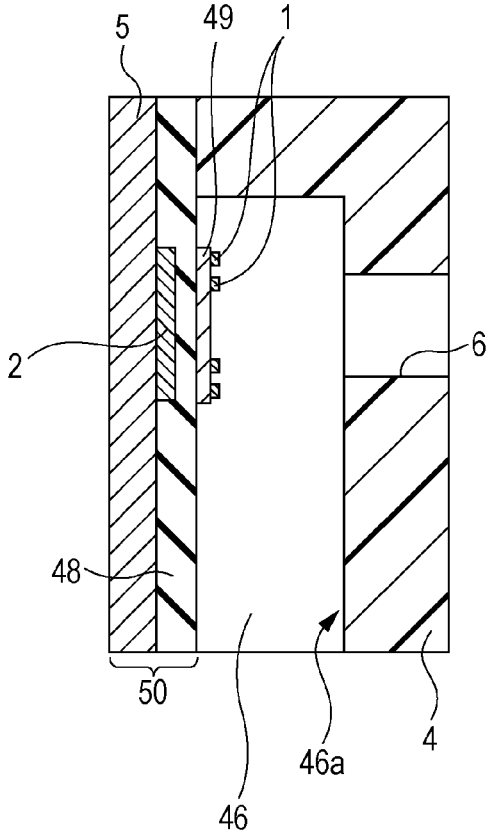

FIG. 4B is a sectional view taken along line IVB-IVB of FIG. 4A. The ejection orifice member 4 is provided with a dummy ejection orifice 6 having the same shape as ejection orifices 3. A heat generating element 2 is provided on a base body 5. An insulating protective layer 48 is provided thereon to protect the heat generating element 2 from liquid. By forming the insulating protective layer 48 having a thickness of about 1.0 μm of an insulating material such as silicon nitride or oxygen nitride, electrical insulation of the heat generating element 2 can be ensured. In addition, a durable protective layer 49 is provided on the insulating protective layer 48. The durable protective layer 49 is used to protect the heat generating element 2 from shock that occurs when liquid is ejected (cavitation). The durable protective layer 49 can be formed of a material having resistance to ink and excellent resistance to shock, such as tantalum. The thickness of the durable protective layer 49 is desirably at least about 0.2 μm but no more than about 1.0 μm. An examination member 1 having a plurality of protruding portions is provided on the surface of the durable protective layer 49. Thus, a liquid ejection head substrate 50 having a surface having a heat generating element 2 is formed. The protruding portions have such a thickness that the protruding portions can be recognized when the examination member 1 is checked through the dummy ejection orifice 6. The thickness of the protruding portions is desirably at least about 0.1 μm but no more than about 0.5 μm.

Above the surface of the liquid ejection head substrate 50, a recess 46*a* is provided that is communicated with the dummy ejection orifice 6. When the ejection orifice member 4 is in contact with the liquid ejection head substrate, the recess 46*a* forms a part of a flow passage 46. The ejection orifice member 4 can be formed of a hardened thermoplastic resin such as epoxy resin. The ejection orifice member 4 is provided on the liquid ejection head substrate and has a thickness of at least about 20.0 μm but no more than about 100.0 μm.

Ejection orifices 3 (not shown) are provided at positions facing heat generating elements 2. Similarly, the dummy ejection orifice 6 is provided so as to face the heat generating element 2. In addition, an examination member 1 is located at a position facing the dummy ejection orifice 6 and above the heat generating element 2.

The size of the dummy ejection orifice 6, that is to say, the size of the ejection orifices 3 can be classified, and the liquid ejection head can be ranked according to the extent to which the examination member 1 can be checked through the opening of the dummy ejection orifice 6 when the surface of the liquid ejection head substrate is viewed from the dummy ejection orifices 6 side.

On the basis of the result, the state of the liquid ejection head is written into an information storage medium (not shown), and ejection control suited to each liquid ejection head is performed. Thus, if there are differences between individual liquid ejection heads, differences in recording quality can be eliminated.

FIGS. 5A to 5H show examples of shapes used as such an examination member 1. The examination member 1 shown in FIG. 5A includes a first examination member 8 and a second examination member 9 that are shaped like concentric circles.

Next, an example of a method for ranking a liquid ejection head having such an examination member 1 will be described.

The first examination member 8 is circular, and its diameter is smaller than the designed diameter of the ejection orifices 3 (and the dummy ejection orifice 6). The second examination member 9 is circular, and its diameter is larger than the designed diameter of the ejection orifices 3 (and the dummy ejection orifice 6). By previously obtaining the amount of liquid droplet ejected from the ejection orifices 3 relative to the diameter of the ejection orifices 3, it is possible to estimate the diameter of the ejection orifices 3 from the positional relationship between the dummy ejection orifice 6 and the examination member 1 and to rank the amount of ejection.

Figure 5A:
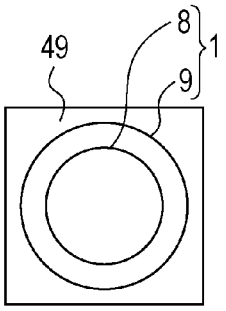
FIGS. 5A to 5H are top plan schematic views showing the shapes of examination members of the first embodiment.

In the case where the examination member 1 includes two members as shown in FIG. 5A, a three-tiered ranking can be performed. When a dummy ejection orifice 6 has a diameter larger than the diameter of the second examination member 9, the dummy ejection orifice 6 is classified into "large." When a dummy ejection orifice 6 has a diameter larger than the diameter of the first examination member 8 but smaller than the diameter of the second examination member 9, the dummy ejection orifice 6 is classified into "medium." When a dummy ejection orifice 6 has a diameter smaller than the diameter of the first examination member 8, the dummy ejection orifice 6 is classified into "small." The rank into which a dummy ejection orifice 6 is classified can be determined by performing examination through the opening of the dummy ejection orifice 6 by human eye or using a measurement device.

Figure 5B:
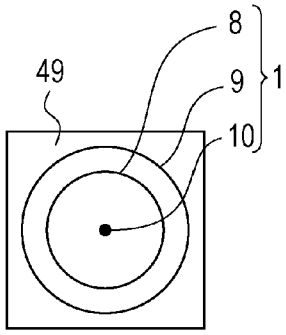

As shown in FIG. 5B, a central point 10 may be added to the configuration shown in FIG. 5A. If the central point 10 is provided, the amount of misalignment between the center of the ejection orifice 3 and the center of the examination member 1 can be checked.

In addition, by locating the central point 10 at the designed central position of the dummy ejection orifice 6, it is possible to learn the amount of displacement from the designed position of the dummy ejection orifice 6, to estimate the amount of displacement of the ejection orifices 3, and to estimate the amount of displacement of the landing positions of ejected liquid droplets. By storing this information in the information storage medium in the liquid ejection apparatus and performing control based thereon, the landing positions can be corrected.

Figure 5C:
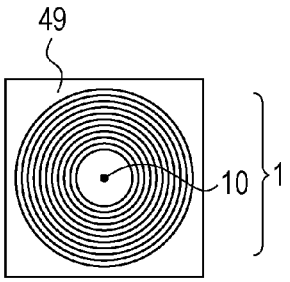

When the examination member 1 has a plurality of circles having different diameters, fine ranking can be performed. In the case of an N-tiered ranking system, the examination member 1 has N-1 circles. If one wants to obtain the precise opening area of the dummy ejection orifice 6, the examination member 1 may have many concentric circles as shown in FIG. 5C.

Figure 5D:
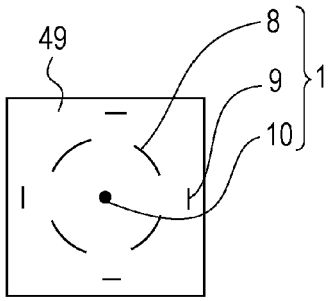
Figure 5E:
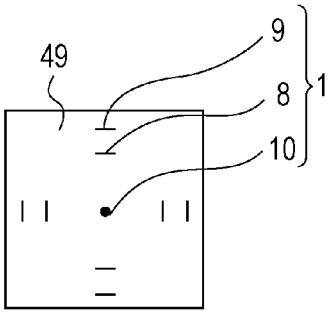
Figure 5F:
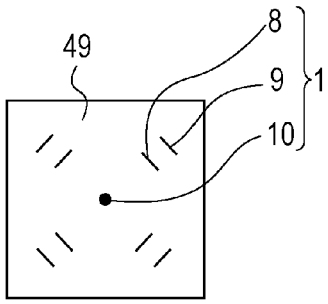
Figure 5G:
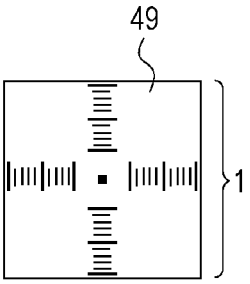
Figure 5H:
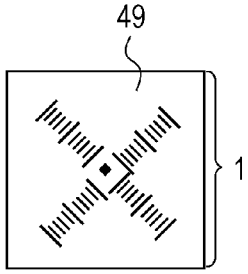

Alternatively, the examination member 1 may have parts of concentric circles as shown in FIG. 5D, or parts of concentric squares as shown in FIGS. 5E and 5F. The examination member 1 may have parts of many concentric squares like scales as shown in FIGS. 5G and 5H. The examination member 1 may have a combination of parts of a circle and parts of a square.

Next, an example of a method for making the examination member 1 of this embodiment will be described.

Figure 6A:
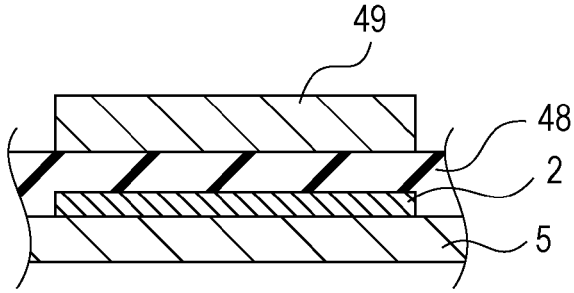
FIGS. 6A to 6D are sectional views showing a method for making the examination member of the first embodiment.
Figure 6B:
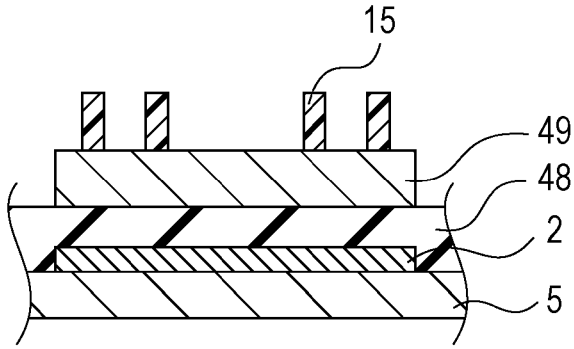
Figure 6C:
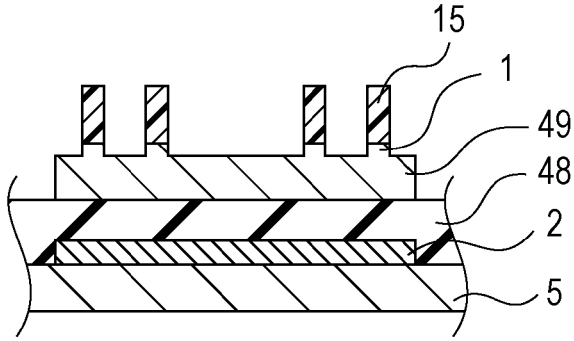
Figure 6D:
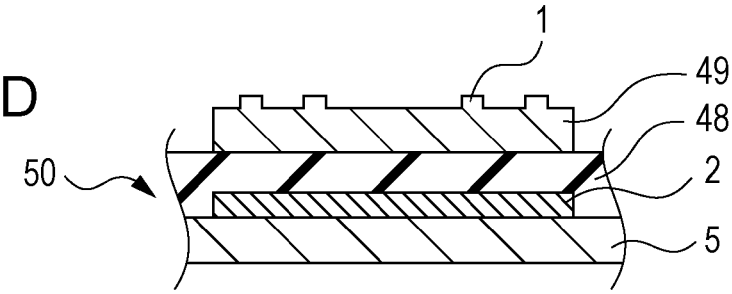

FIGS. 6A to 6D show a method for making a liquid ejection head substrate according to this embodiment. FIGS. 6A to 6D are enlarged views of a part of the liquid ejection head substrate of FIG. 4B. First, as shown in FIG. 6A, a base body 5 is prepared on which an insulating protective layer 48 is formed on which a durable protective layer 49 having a thickness of about 0.5 μm is formed of tantalum, for example, by sputtering. Next, as shown in FIG. 6B, a mask 15 is formed of photoresist at a position where an examination member 1 is to be formed on the durable protective layer 49, for example, by photolithography. Next, as shown in FIG. 6C, using an etching technique such as dry etching, the parts of the durable protective layer 49 on which the mask 15 is not formed are reduced in thickness by about 0.1 μm. Next, as shown in FIG. 6D, the mask 15 is removed. Through the above process, a liquid ejection head substrate 50 having an examination member 1 can be completed.

Next, an ejection orifice member 4 is provided on the liquid ejection head substrate 50. The ejection orifice member 4 is formed of hardened epoxy resin and has ejection orifices 3 and a dummy ejection orifice 6 that are formed at the same time using a photolithographic technique and an etching technique. Thus, the liquid ejection head 41 of FIG. 4B is completed.

While some parts of a durable protective layer 49 serve as an examination member 1 in the first embodiment, a durable protective layer 49 and an examination member 1 are formed of different materials in a second embodiment. The shape of the examination member 1 and ranking are the same as those in the first embodiment.

Figure 7A:
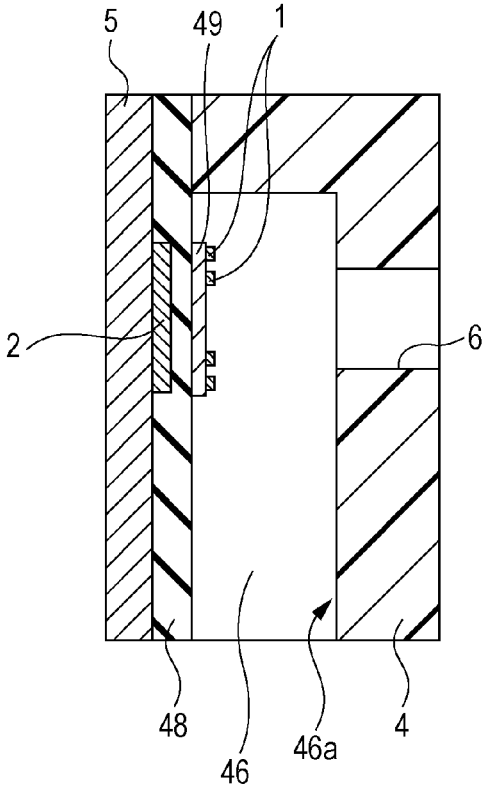
FIGS. 7A and 7B are sectional views of a dummy ejection orifice of a second embodiment.
Figure 7B:
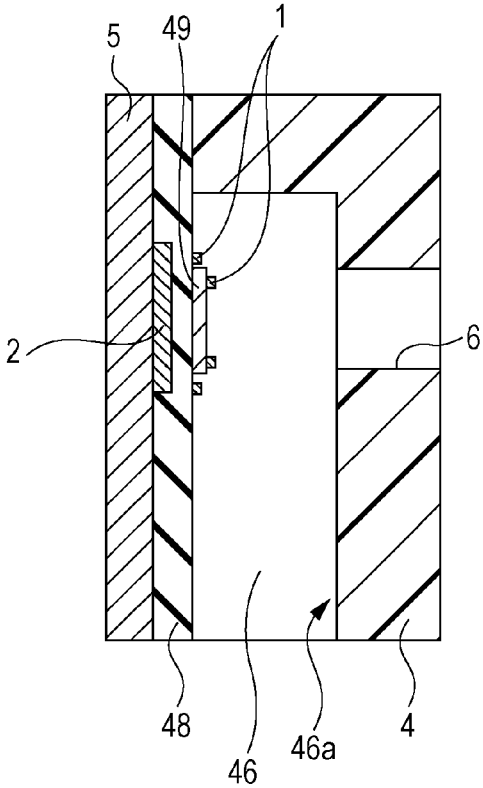

FIGS. 7A and 7B are sectional views taken along line VII-VII of FIG. 4A. An examination member 1 is formed, for example, of a metal material on a durable protective layer 49 (FIG. 7A). Alternatively, a part of an examination member 1 may be formed on an insulating protective layer 48 (FIG. 7B). When a part of an examination member 1 is formed on an insulating protective layer 48, evaluation can be performed even when a durable protective layer 49 is smaller than the examination member 1.

The examination member 1 is desirably formed of a metal material that is easy to recognize at the time of examination and is easy to process at the time of manufacture, for example, an aluminum-, copper-, silver-, or gold-based material.

Next, an example of a method for making an examination member 1 of this embodiment will be described.

Figure 8A:
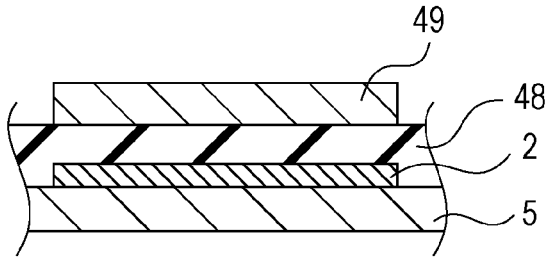
FIGS. 8A to 8E are sectional views showing a method for making an examination member of the second embodiment.
Figure 8B:
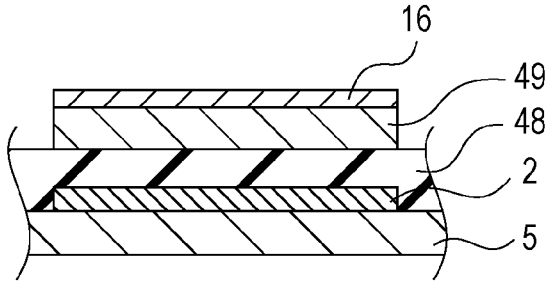
Figure 8C:
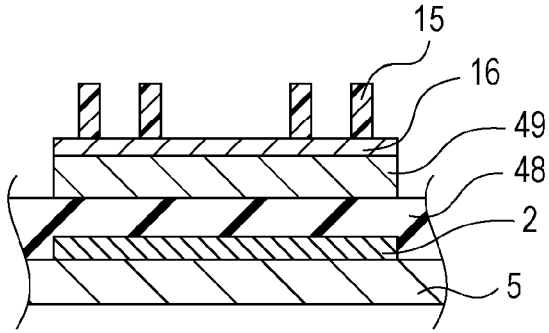
Figure 8D:
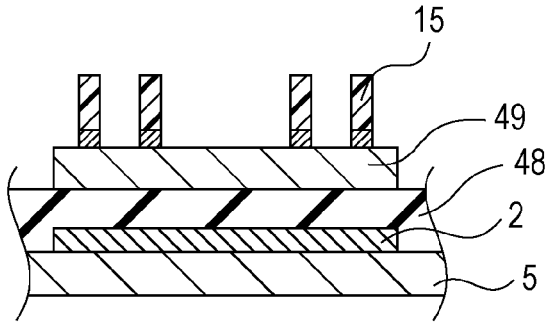
Figure 8E:
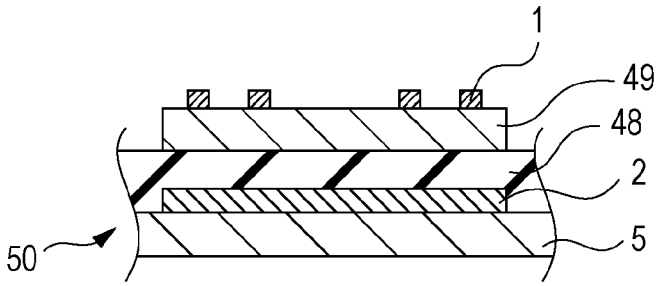

FIGS. 8A to 8E show a method for making a liquid ejection head substrate according to this embodiment. FIGS. 8A to 8E are enlarged views of a part of the liquid ejection head substrate of FIG. 7A. First, as shown in FIG. 8A, a base body 5 is prepared on which an insulating protective layer 48 is formed on which a durable protective layer 49 having a thickness of about 0.5 μm is formed, for example, of tantalum, for example, by sputtering. Next, as shown in FIG. 8B, a layer 16 of a metal, such as aluminum, is formed on the durable protective layer 49, for example, by sputtering. Next, as shown in FIG. 8C, a mask 15 is formed of photoresist at a position where an examination member 1 is to be formed on the metal layer 16, for example, by photolithography. Next, as shown in FIG. 8D, using an etching technique such as dry etching, the parts of the metal layer 16 on which the mask 15 is not formed are removed. Next, as shown in FIG. 8E, the mask 15 is removed. Through the above process, a liquid ejection head substrate 50 having an examination member 1 can be completed.

Next, an ejection orifice member 4 is provided on the liquid ejection head substrate 50. The ejection orifice member 4 is formed of hardened epoxy resin and has ejection orifices 3 and a dummy ejection orifice 6. Thus, the liquid ejection head 41 of FIG. 4B is completed.

Also in the case of the examination member 1 formed as above, the size of the dummy ejection orifice 6, that is to say, the size of the ejection orifices 3 can be classified by determining whether the examination member 1 can be checked through the opening of the dummy ejection orifice 6 as in the first embodiment. In addition, by checking the amount of misalignment between the dummy ejection orifice 6 and the examination member 1, the amount of misalignment between the ejection orifice member 4 and the liquid ejection head substrate can be estimated.

Figure 9A:
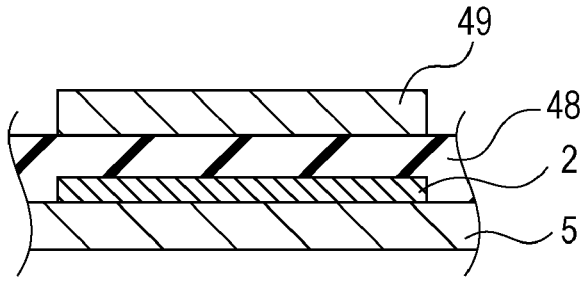
FIGS. 9A to 9D are sectional views showing a method for making an examination member of a third embodiment.
Figure 9B:
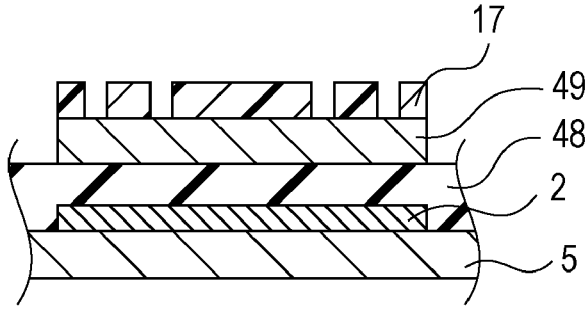
Figure 9C:
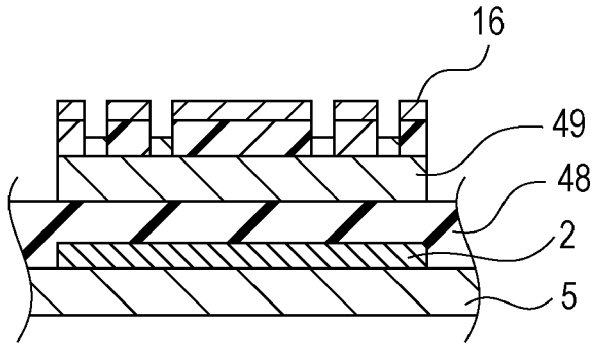
Figure 9D:
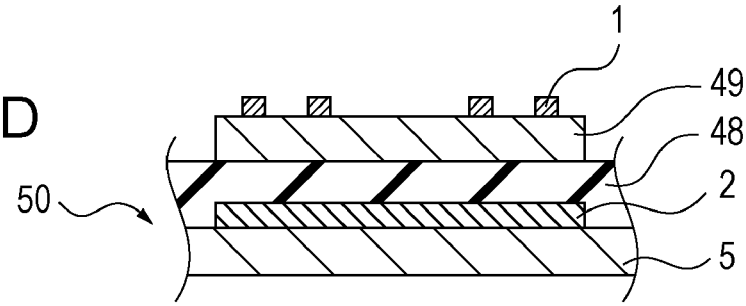

Another method for making the liquid ejection head substrate of the second embodiment is shown in FIGS. 9A to 9D (third embodiment). FIGS. 9A to 9D are enlarged views of a part of the liquid ejection head substrate of FIG. 7A. First, as shown in FIG. 9A, a base body 5 is prepared on which an insulating protective layer 48 is formed on which a durable protective layer 49 having a thickness of about 0.5 μm is formed of tantalum, for example, by sputtering. Next, as shown in FIG. 9B, a mask 17 is formed of photoresist in parts other than a region where an examination member 1 is to be formed on the durable protective layer 49, for example, by photolithography. Next, as shown in FIG. 9C, a layer 16 of a metal, such as aluminum, is formed on the mask 17 and the durable protective layer 49, for example, by sputtering. Next, as shown in FIG. 9D, the mask 17 and parts of the metal layer 16 formed on the mask 17 are removed. Through the above process, a liquid ejection head substrate 50 having an examination member 1 can be completed.

Next, an ejection orifice member 4 is provided on the liquid ejection head substrate 50. The ejection orifice member 4 is formed of hardened epoxy resin and has ejection orifices 3 and a dummy ejection orifice 6. Thus, the liquid ejection head 41 of FIG. 4B is completed.

In the first to third embodiments, ranking is performed by comparing the size and position of a dummy ejection orifice with those of an examination member. In a fourth embodiment, ranking is performed by evaluating whether a measurement device can focus on an examination member. The fourth embodiment is the same as the first embodiment except for the shape of the examination member.

Figure 10A:
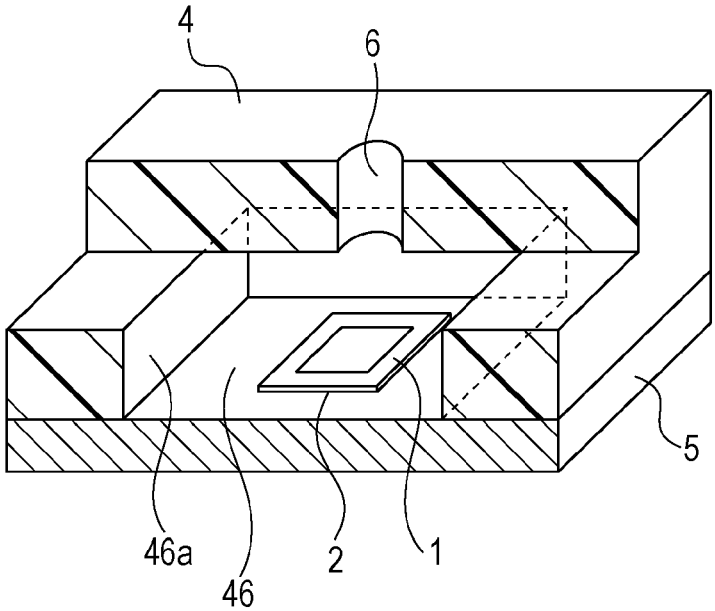
FIGS. 10A and 10B are a partially see-through perspective view and a top plan view, respectively, of a dummy ejection orifice according to the present invention.
Figure 10B:
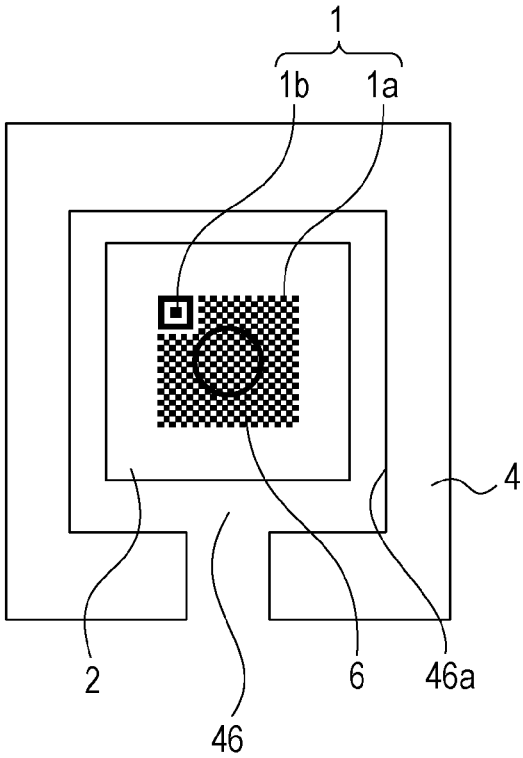

FIG. 10A is a partially see-through cross-sectional perspective view of a dummy ejection orifice 6 provided in a liquid ejection head 41. FIG. 10B is a top plan view of the dummy ejection orifice 6. The examination member 1 has a plurality of cells 1*a* arranged at regular intervals in a first direction (X direction) and a second direction (Y direction) perpendicular to the first direction, and at least one alignment mark 1*b* that an examination device uses for focusing. The alignment mark is located under the ejection orifice member 4 when the liquid ejection head substrate is viewed from the side where the dummy ejection orifice 6 is provided. Due to the manufacturing variations, the size of the opening of the dummy ejection orifice 6 may vary. Therefore, the alignment mark 1*b* is desirably located at a position sufficiently distant from the dummy ejection orifice 6.

Figure 11A:
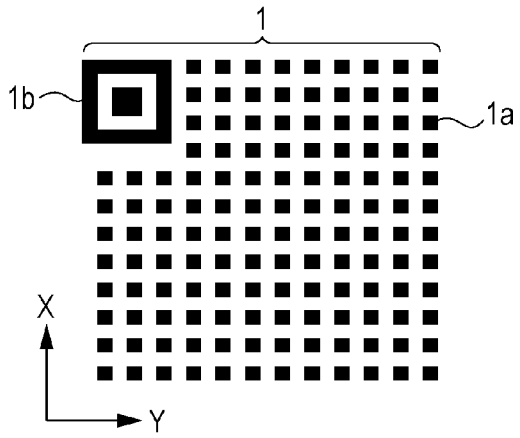
FIGS. 11A to 11D are examples of schematic views of examination members according to the present invention.
Figure 11B:
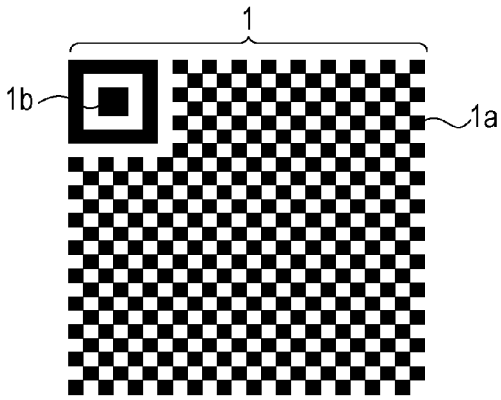

FIGS. 11A to 11D show examples of such an examination member 1. The examination member 1 can include a plurality of square cells arranged at regular intervals in the vertical and horizontal directions as shown in FIG. 11A. The cells may be offset from each other by half a pitch as shown in FIG. 11B. By reducing the size of cells and increasing the number of cells per unit area, the area of the opening of the dummy ejection orifice 6 can be precisely checked. Examples of the shape of each cell include, in addition to a square shape shown in FIGS. 11A to 11D, a rectangular shape, a circular shape, and an elliptical shape. The area of the region where a plurality of cells are provided is larger than the area of the opening of the dummy ejection orifice 6.

Figure 11C:
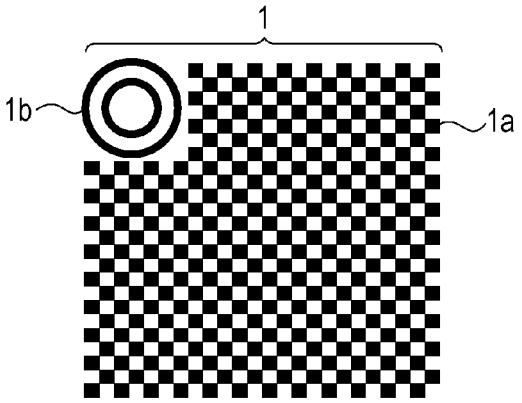
Figure 11D:
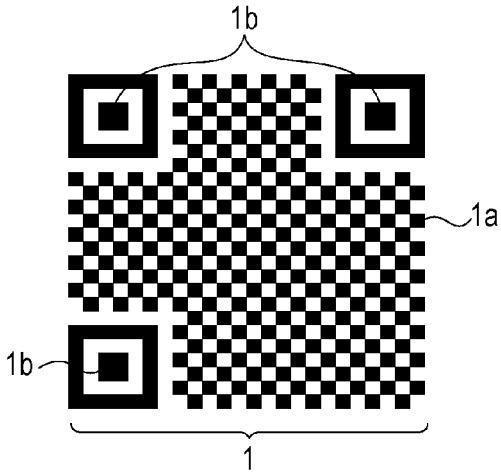

Examples of the shape of the alignment mark 1*b* of the examination member 1 include a combination of squares such as that shown in FIGS. 11A and 11B and a combination of circles such as that shown in FIG. 11C. Alternatively, as shown in FIG. 11D, a plurality of alignment marks may be provided so that the examination member 1 is like a two-dimensional bar code (QR code). Providing a plurality of alignment marks facilitates focusing.

Such a dummy ejection orifice 6 can be evaluated using an examination device, such as a digital camera or a bar code reader. The examination device focuses on the alignment mark of the examination member 1 through the ejection orifice member 4. The ejection orifice member 4 has a material-specific refractive index (optical constant). On the other hand, the opening of the dummy ejection orifice 6 is in an atmospheric state and has a refractive index of 1. For this reason, the optical path length between the examination device and the cells located under the opening of the dummy ejection orifice 6 is different from the optical path length between the examination device and the alignment mark, and therefore the examination device cannot focus on the cells. Consequently, the image information of the cells located under the opening of the dummy ejection orifice 6 is significantly deteriorated, and the cells cannot be recognized by the examination device. From the number of cells that cannot be recognized by the examination device, the area of the opening of the dummy ejection orifice 6 can be measured. The ejection orifice member 4 can be made of a hardened thermohardening resin, such as epoxy resin, and has a transmittance of at least 80% but no more than 90% and a refractive index of 1.5 at a wavelength of 550 nm.

Because the dummy ejection orifice 6 is formed through the same process and under the same conditions as the ejection orifices 3, the ejection orifices 3 can be ranked by ranking the dummy ejection orifice 6 according to the area of the opening. Such an examination member 1 is not provided at a position facing each ejection orifice 3. The reason is that providing each ejection orifice 3 with such a member results in adverse effects, for example, change in the direction in which liquid is ejected at the time of recording operation.

On the basis of the result, the state (rank) of the liquid ejection head is written into an information storage medium (not shown), and on the basis of this, ejection control suited to each liquid ejection head is performed. Thus, if there are differences between individual liquid ejection heads, differences in recording quality can be eliminated. In addition, by calculating the central position of the region of unrecognizable cells and comparing with the designed central position of the dummy ejection orifice 6, it is possible to learn the amount of displacement from the designed position of the dummy ejection orifice 6 and to estimate the amount of displacement of the landing positions of liquid droplets ejected from the ejection orifices 3. By storing this information in the information storage medium in the liquid ejection apparatus and performing control based thereon, the landing positions can be corrected.

Figure 12A:
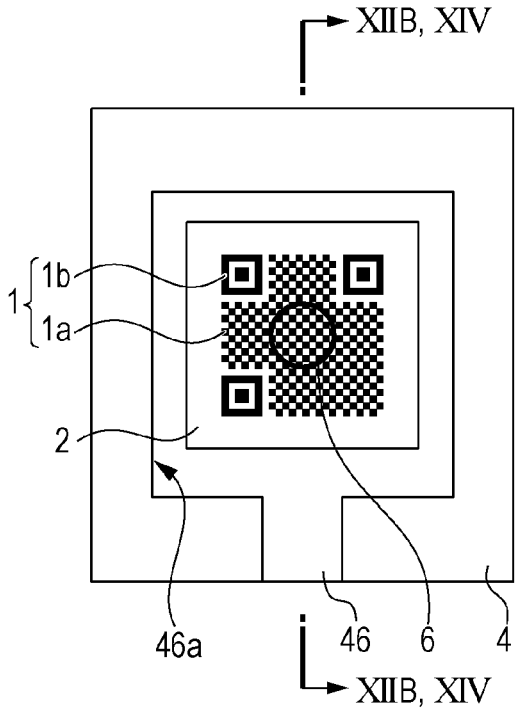
FIGS. 12A and 12B are a top plan schematic view and a sectional view of a dummy ejection orifice of a fourth embodiment.

FIG. 12A is a top plan schematic view of a dummy ejection orifice 6 according to this embodiment. Although a description will be given with reference to the sectional view of the dummy ejection orifice 6, ejection orifices 3 have the same configuration as the dummy ejection orifice 6 except for the examination member 1.

Figure 12B:
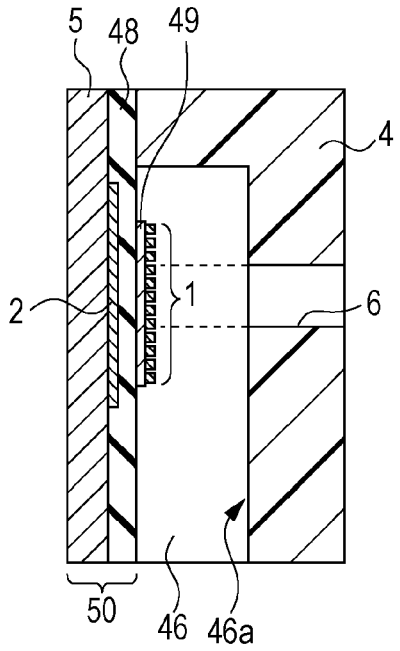

FIG. 12B is a sectional view taken along line XIIB-XIIB of FIG. 12A. The ejection orifice member 4 is provided with a dummy ejection orifice 6 having the same shape as ejection orifices 3. A heat generating element 2 is provided on a base body 5. An insulating protective layer 48 is provided thereon to protect the heat generating element 2 from liquid. By forming the insulating protective layer 48 having a thickness of about 1.0 μm of an insulating material such as silicon nitride or oxygen nitride, electrical insulation of the heat generating element 2 can be ensured. In addition, a durable protective layer 49 is provided on the insulating protective layer 48. The durable protective layer 49 is used to protect the heat generating element 2 from shock that occurs when liquid is ejected (cavitation). The durable protective layer 49 can be formed of a material having resistance to ink and excellent resistance to shock, such as tantalum. The thickness of the durable protective layer 49 is desirably at least about 0.2 μm but no more than about 1.0 μm. An examination member 1 is provided on the surface of the durable protective layer 49. Thus, a liquid ejection head substrate 50 having a surface having a heat generating element 2 is formed. In this embodiment, the examination member 1 has protrusions provided on the surface of the durable protective layer 49. The protrusions have such a size that the protrusions can be recognized when the examination member 1 is examined by an examination device. The size of the protrusions is desirably at least about 0.1 μm but no more than about 0.5 μm.

Above the surface of the liquid ejection head substrate 50, a recess 46*a* is provided that is communicated with the dummy ejection orifice 6. When the ejection orifice member 4 is in contact with the liquid ejection head substrate, the recess 46*a* forms a part of a flow passage 46. The ejection orifice member 4 is formed of hardened epoxy resin. The ejection orifice member 4 is provided on the liquid ejection head substrate and has a thickness of at least about 20.0 μm but no more than about 100.0 μm. Hardened epoxy resin has a transmittance of at least 80% but no more than 90% and a refractive index of 1.5 at a wavelength of 550 nm.

Ejection orifices 3 (not shown) are provided at positions facing heat generating elements 2. Similarly, the dummy ejection orifice 6 is provided so as to face the heat generating element 2. In addition, an examination member 1 like a QR code is located at a position facing the dummy ejection orifice 6 and above the heat generating element 2.

Figure 12C:
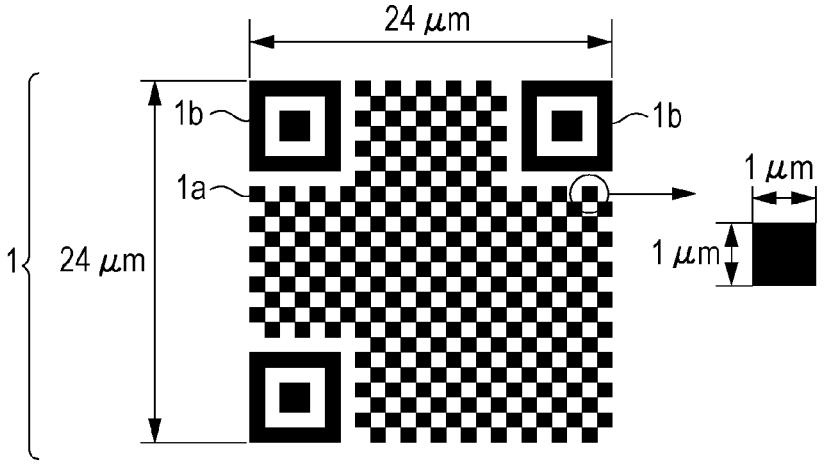
FIG. 12C is an enlarged view of the examination member shown in FIG. 12A.

FIG. 12C is an enlarged view of the examination member 1. In this embodiment, the examination member 1 is a square 24.0 μm on a side and includes three alignment marks and a plurality of cells. The three alignment marks of the examination member 1 are located under the ejection orifice member 4 when the liquid ejection head substrate is viewed from the side where the dummy ejection orifice 6 is provided. By performing alignment at three points, the examination device can reliably focus on the position where the examination member 1 is provided.

In addition, at a position facing the opening of the dummy ejection orifice 6 when the liquid ejection head substrate is viewed from the side where the dummy ejection orifice 6 is provided, rows in which a plurality of cells that are squares 1.0 μm on a side are regularly arranged are offset from each other by half a pitch and are disposed in a matrix. The examination device focuses on the alignment marks of the examination member 1 through the ejection orifice member 4. The refractive index of the ejection orifice member 4 is 1.5, whereas the refractive index of the opening (atmosphere) is 1. For this reason, the optical path length between the examination device and the cells located under the opening of the dummy ejection orifice 6 is different from the optical path length between the examination device and the alignment marks, and therefore the examination device cannot focus on the cells. By checking the area of the opening of the dummy ejection orifice 6 from the number of cells not in focus, the area of the openings of the ejection orifices 3 can be estimated without ejecting liquid or measuring the diameter of the ejection orifices 3. On the basis of this result, the liquid ejection head can be ranked.

Figures 13A, 13B:
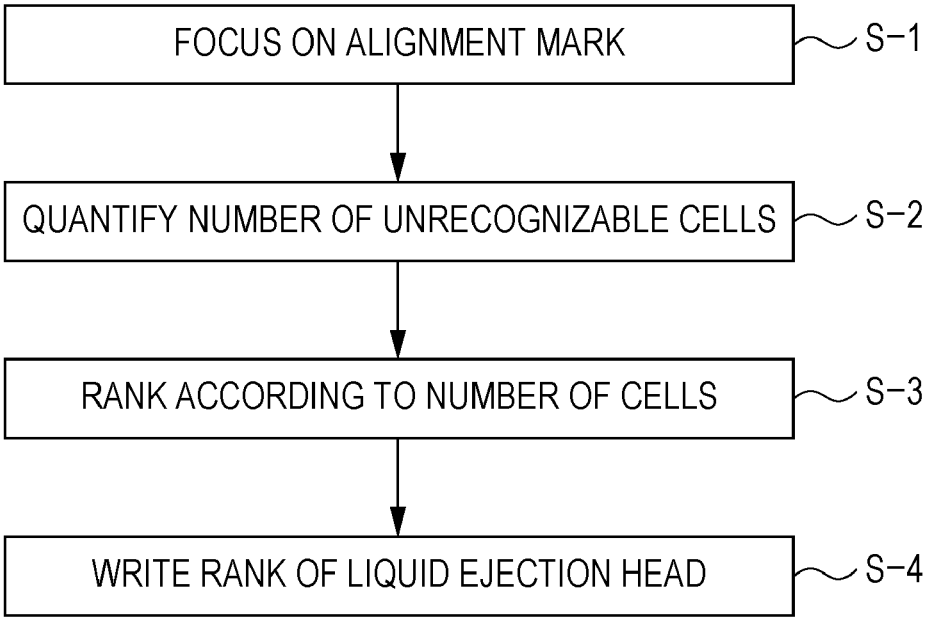
FIGS. 13A and 13B illustrate a method for ranking ejection orifices using an examination member of the fourth embodiment.

Next, a method for ranking ejection orifices using such an examination member 1 will be described with reference to a flowchart of FIG. 13A. First, when the liquid ejection head substrate 50 is viewed from the dummy ejection orifices 6 side, a bar code reader (examination device) focuses on the alignment marks 1*b* of the examination member 1 through the ejection orifice member 4 (S-1). Next, the number of cells in focus is subtracted from the total number of cells, and thereby, the number of cells that are located under the opening of the dummy ejection orifice 6 and are unrecognizable is quantified (S-2). Next, according to the number of unrecognizable cells, the liquid ejection head is ranked (S-3). An example of ranking is shown in FIG. 13B. When the number of unrecognizable cells is less than 83, the liquid ejection head is ranked as A. When the number of unrecognizable cells is equal to or greater than 83 but less than 94, the liquid ejection head is ranked as B. When the number of unrecognizable cells is equal to or greater than 94 but less than 107, the liquid ejection head is ranked as C. When the number of unrecognizable cells is equal to or greater than 107 but less than 120, the liquid ejection head is ranked as D. When the number of unrecognizable cells is equal to or greater than 120, the liquid ejection head is ranked as E. The greater the number of ranks, the more precisely the liquid ejection head can be ranked. Next, when the liquid ejection head is mounted in a liquid ejection apparatus, the rank is written into an information storage medium (not shown) of the liquid ejection apparatus (S-4).

On the basis of the above ranks, control suited to each liquid ejection head is performed. Thus, if there are differences between individual liquid ejection heads, differences in the amount of ejection and recording quality can be eliminated. In the case where a plurality of liquid ejection heads are provided in a head unit, the recording quality can be further improved by employing liquid ejection heads in the same rank.

In addition, by calculating the central position of the region of unrecognizable cells and comparing with the designed central position of the dummy ejection orifice 6, it is possible to learn the amount of displacement from the designed position of the dummy ejection orifice 6 and to estimate the amount of displacement of the landing positions of liquid droplets ejected from the ejection orifices 3. By storing this information in the information storage medium in the liquid ejection apparatus and performing control based thereon, the landing positions can be corrected.

The examination member 1 of this embodiment can be formed using the method of the first embodiment.

While some parts of a durable protective layer 49 serve as an examination member 1 in the fourth embodiment, a durable protective layer 49 and an examination member 1 are formed of different materials in a fifth embodiment. The alignment method using the examination member 1 and ranking are the same as those in the fourth embodiment. The examination member 1 of this embodiment can be formed using the method of the second or third embodiment.

Figure 14A:
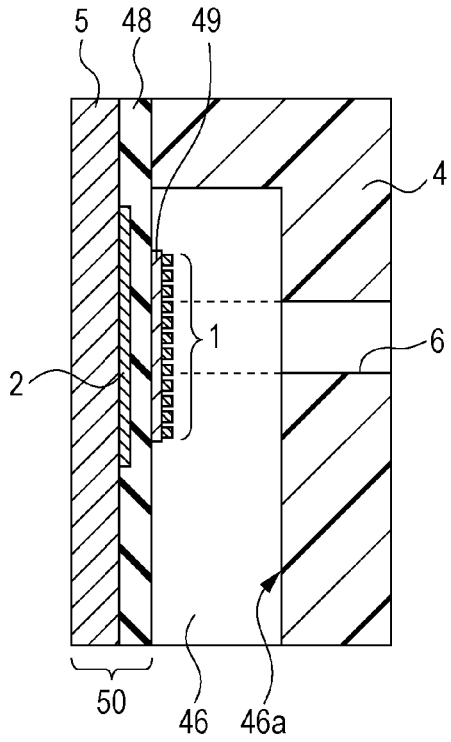
FIGS. 14A and 14B are sectional views of a dummy ejection orifice of a fifth embodiment.
Figure 14B:
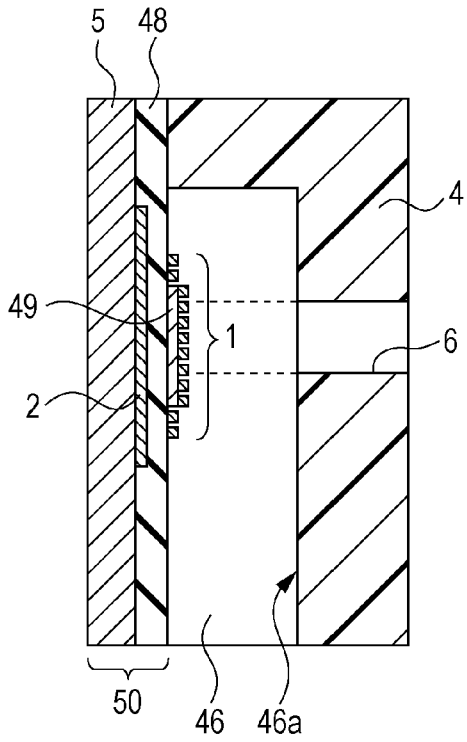
Figure 15:
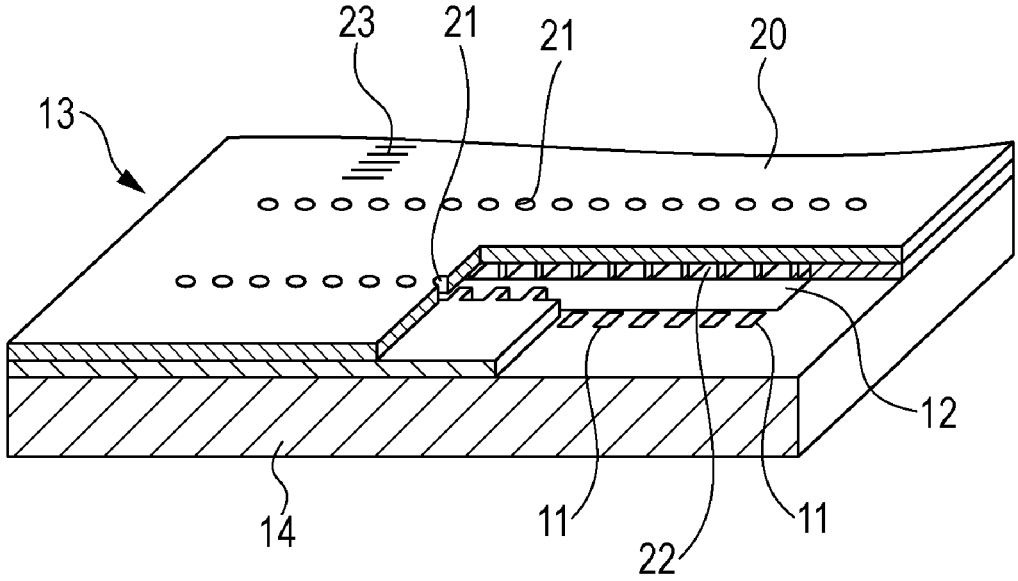
FIG. 15 is a partially see-through perspective view of a conventional liquid ejection head.

FIGS. 14A and 14B are sectional views taken along line XIV-XIV of FIG. 12A. An examination member 1 is formed, for example, of a metal material on a durable protective layer 49 (FIG. 14A). Alternatively, a part of an examination member 1 may be formed on an insulating protective layer 48 (FIG. 14B). When a part of an examination member 1 is formed on an insulating protective layer 48, evaluation can be performed even when a durable protective layer 49 is smaller than the examination member 1.

The examination member 1 is desirably formed of a metal material that is easy to recognize at the time of examination and is easy to process at the time of manufacture, for example, an aluminum-, copper-, silver-, or gold-based material.

If recording operation is performed for a long period of time using the liquid ejection head of the fourth or fifth embodiment described above, the ejection orifice member 4 made of hardened epoxy resin swells due to the prolonged exposure to ink, and therefore the shape of the ejection orifices 3 changes. By providing an examination device such as a bar code reader in the liquid ejection head apparatus, checking the number of unrecognizable cells of the examination member 1 of the liquid ejection head being used, and quantifying the number again, the area of the opening of the dummy ejection orifice 6 can be checked, and ranking can be performed again. By periodically performing this ranking and adjusting ejection conditions, the liquid ejection head can be adjusted so that the amount of ejection is constant.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2009-288807 filed Dec. 21, 2009 and No. 2009-288808 filed Dec. 21, 2009, which are hereby incorporated by reference herein in their entirety.

What is claimed is:

1. A liquid ejection head comprising:

a liquid ejection head substrate including a surface having energy generating elements that generate energy for ejecting liquid; and an ejection orifice member having a facing portion that faces the surface and a plurality of through-holes defined through the facing portion, wherein the plurality of through-holes include liquid ejection orifices corresponding to the energy generating elements, and wherein a part of the surface facing a portion of the plurality of through-holes is provided with an examination member facilitating examining a state of the portion of the plurality of through-holes.

2. The liquid ejection head according to claim 1, wherein the examination member includes a plurality of protruding portions.

3. The liquid ejection head according to claim 1, wherein the examination member is at least part of a plurality of concentric circles having different diameters, a plurality of concentric squares having different sizes, or a combination thereof.

4. The liquid ejection head according to claim 3, wherein the examination member has a central point.

5. The liquid ejection head according to claim 3, wherein the examination member has a first examination member having a diameter smaller than a designed diameter of the plurality of through-holes and a second examination member having a diameter larger than the designed diameter of the plurality of through-holes.

6. The liquid ejection head according to claim 1, wherein the examination member includes an alignment mark that an examination device uses for focusing and a plurality of cells arranged in a first direction and a second direction perpendicular to the first direction.

7. The liquid ejection head according to claim 6, wherein the plurality of cells are arranged at regular intervals along the first and second directions.

8. The liquid ejection head according to claim 6, wherein the area of the region where the plurality of cells are provided is larger than an opening area of each through-hole.

9. The liquid ejection head according to claim 6, wherein the alignment mark is located under the ejection orifice member when the substrate is viewed from the side where the ejection orifice member is provided.

10. The liquid ejection head according to claim 6, wherein a portion of the plurality of cells is located under the through-hole when the substrate is viewed from the side where the ejection orifice member is provided.

11. The liquid ejection head according to claim 6, wherein the examination member is like a QR code.

12. The liquid ejection head according to claim 6, wherein the ejection orifice member is made of hardened epoxy resin.

13. A method for evaluating the liquid ejection head according to claim 6, comprising estimating an opening area of the through-hole facing the examination member by checking how many of the plurality of cells are in focus when an examination device that examines the liquid ejection head focuses on the alignment mark.

14. A liquid ejection apparatus in which the liquid ejection head according to claim 1 can be mounted, comprising a control unit configured to perform ejection control of the liquid ejection head.

15. A method for evaluating the liquid ejection head according to claim 3, comprising evaluating the liquid ejection head according to whether the examination member can be checked through the through-hole when the surface is viewed from an upper side of the ejection orifice member.

* * * * *